US006554595B2

(12) United States Patent
Hida et al.

(10) Patent No.: US 6,554,595 B2
(45) Date of Patent: Apr. 29, 2003

(54) COMPRESSOR WITH OIL-MIST SEPARATOR

(75) Inventors: Takeshi Hida, Shimizu (JP); Shigekazu Nozawa, Shimizu (JP); Masayuki Urashin, Shimizu (JP); Hiroki Osumimoto, Shimizu (JP); Hirotaka Kameya, Tsuchiura (JP); Atsushi Watanabe, Chiyoda (JP)

(73) Assignee: Hitachi, Ltd., Tokyo (JP); trustee, for the benefit of Hitachi Air Conditioning Systems Co., Ltd.

( * ) Notice: Subject to any disclaimer, the term of this patent is extended or adjusted under 35 U.S.C. 154(b) by 0 days.

(21) Appl. No.: 09/846,262

(22) Filed: May 2, 2001

(65) Prior Publication Data

US 2002/0054823 A1 May 9, 2002

(30) Foreign Application Priority Data

Nov. 6, 2000 (JP) ..... 2000-342381

(51) Int. Cl.[7] ..... F04C 29/02; B01D 19/00

(52) U.S. Cl. ..... 418/201.1; 418/DIG. 1; 96/209

(58) Field of Search ..... 418/DIG. 1, 201.1; 55/459.1; 95/261; 96/209, 216

(56) References Cited

U.S. PATENT DOCUMENTS

| | | | | | |
|---|---|---|---|---|---|
| 441,995 | A | * | 12/1890 | Wheeler | 55/459.1 |
| 1,505,743 | A | * | 8/1924 | Stebbins | 55/459.1 |
| 4,506,523 | A | * | 3/1985 | DiCarlo et al. | 55/459.1 |

FOREIGN PATENT DOCUMENTS

| | | | | |
|---|---|---|---|---|
| DE | 641877 | * | 2/1937 | 55/459.1 |
| JP | 55-117092 | * | 9/1980 | 418/DIG. 1 |
| JP | 4-153596 | * | 5/1992 | 418/DIG. 1 |
| JP | 7-243391 | * | 9/1995 | |
| RU | 1634827 | * | 3/1991 | 418/DIG. 1 |

* cited by examiner

*Primary Examiner*—John J. Vrablik
(74) *Attorney, Agent, or Firm*—Antonelli, Terry, Stout & Kraus, LLP

(57) ABSTRACT

In an oil-mist separator included by a compressor, an inlet passage directs a flow axis of a mixture gas including a mist of lubrication oil and a gas to be taken out of the compressor with a pressurized condition when the mixture gas reaches a chamber, and a discharge port for discharging the gas from the chamber opens in the chamber.

21 Claims, 8 Drawing Sheets

A - A

A - A

B - B

A - A

B - B

COMPRESSOR WITH OIL-MIST SEPARATOR

BACKGROUND OF THE INVENTION AND RELATED ART STATEMENT

The present invention relates to a compressor including an oil-mist separator.

JP-A-7-243391 discloses a cyclone type oil separator in which an oil is separated from a gas flowing out of a compressor by utilizing a centrifugal force applied to the gas.

OBJECT AND SUMMARY OF THE INVENTION

An object of the present invention is to provide a compressor including an oil-mist separator, in which a mist of lubrication oil is separated effectively from a gas after being compressed, in a simple and cheap structure.

In a compressor for compressing a mixture gas including a mist of lubrication oil and a gas to be taken out of the compressor with a pressurized condition, comprising, a pair of compressing members movable with respect to each other so that the mixture gas is compressed therebetween, an electric motor for driving at least one of the compressing members to generate a relative movement between the compressing members for compressing the mixture gas, and an oil-mist separator for separating the mist of lubrication oil from the mixture gas to collect the lubrication oil, according to the present invention, the oil-mist separator includes an inner surface forming a chamber for receiving the mixture gas, an inlet passage for directing a flow axis of the mixture gas when the mixture gas reaches the chamber, and a discharge passage includes a discharge port opening in the chamber to discharge the gas from the chamber through the discharge port.

Since the discharge port of the discharge passage opens in the chamber, that is, the mixture gas surrounds circumferentially the discharge port to swirl around the discharge port, a concentration of the mist of lubrication oil at the discharge port is kept small by a centrifugal force applied to the mist of lubrication oil.

It is preferable for generating effectively the centrifugal force suitable for separating the mist of lubrication oil from the mixture gas that the chamber is cylindrical, and/or the chamber and the discharge passage or discharge port are coaxial.

If a tubular member whose inner surface forms the discharge passage projects in the chamber to be surrounded circumferentially by the mixture gas, that is, the mixture gas surrounding the discharge passage extends longitudinally along the discharge passage formed in the tubular member in the chamber and contacts the tubular member with a large contact area therebetween, the swirl flow of the mixture gas is formed around the discharge passage of tubular member to separate the mist of lubrication oil away from the discharge passage or port, and a temperature of the tubular member is kept high although the discharge passage communicates with the outside of the compressor or oil-mist separator, to restrain a vapor of the lubrication oil from being liquefied on the tubular member so that the mist of lubrication oil is restrained from being introduced into the discharge passage. It is preferable for restraining the mist of lubrication oil from proceeding in the discharge passage toward the outside of the compressor or oil-mist separator that the tubular member projects vertically downward in the chamber, that the discharge port is prevented from facing to the inlet passage, and/or that the discharge port opens vertically downward.

It is preferable for effectively separating the mist of lubrication oil from the mixture gas by the centrifugal force that the inlet passages extends in such a manner that the flow axis of the mixture gas is directed by the inlet passage to an annular part of the inner surface so that the swirl flow of the mixture gas is effectively generated along the annular part of the inner surface, and/or that the inlet passages extends in such a manner that the flow axis of the mixture gas directed by the inlet passage is prevented from being perpendicular to an imaginary tangential plane of a point of the inner surface on the flow axis so that the mixture gas directed by the inlet passage is restrained from being divided at the point of the inner surface to at least two mixture gas components whose flow directions are opposite to each other.

It is preferable for restraining the mist of lubrication oil separated from the mixture oil at the inner surface from being introduced into the discharge port or passage that a baffle is arranged between the discharge port and the inner surface to bend a flow direction of the mixture gas toward the discharge port so that the mist of lubrication oil is collected by the baffle. It is preferable for increasing a mist collection efficiency of the baffle that the baffle includes a sheet having through-holes through which the mixture gas is allowed to flow toward the discharge port, or that the baffle includes a pair of the sheets, and each of the sheets has the through-holes so that a flow direction of the mixture gas toward the discharge port is bent by each of the sheets. An opening area of each of the through-holes of one of the sheets may be different from an opening area of each of the through-holes of another one of the sheets. The sheet may include at least one of a glass-wool, a wire net and a perforated plate.

It is preferable for effectively collecting the oil mist on the inner surface and securely holding the collected mist on the inner surface that the inner surface includes at least one of a glass-wool, a wire net, a spiral groove surrounding the discharge port as seen vertically, a groove extending vertically, and a shot-blasted surface.

It is preferable for restraining the oil mist from proceeding toward the discharge port and returning to the inner surface the oil mist released from the inner surface after being collected by the inner surface that the chamber containing therein at least one ring-shaped member having a tapered surface, and a diameter of the tapered surface decreases vertically downward.

It is preferable for restraining the oil mist from being introduced into the discharge port or passage when the inlet passage includes at an end thereof an inlet port opening to the chamber that the discharge port is arranged at a position lower than the inlet port. It is preferable for restraining the oil mist from being introduced into the discharge port or passage in a case of that the inlet passage extends horizontally to direct the flow axis of the mixture gas horizontally when the mixture gas reaches the chamber and includes at an end thereof an inlet port opening to the chamber, that the discharge port opens at a position lower than the inlet port.

It is preferable for restraining the mist of lubrication oil separated from the mixture oil at the inner surface from being introduced into the discharge port or passage that the baffle extends to a vertical position upper than the discharge port, and/or that the inlet passage extends horizontally to direct the flow axis of the mixture gas horizontally when the mixture gas reaches the chamber and includes at the end thereof an inlet port opening to the chamber, and the baffle extends to a position upper than at least a portion of the inlet port.

DETAILED DESCRIPTION OF PREFERRED EMBODIMENTS

Figure 1:
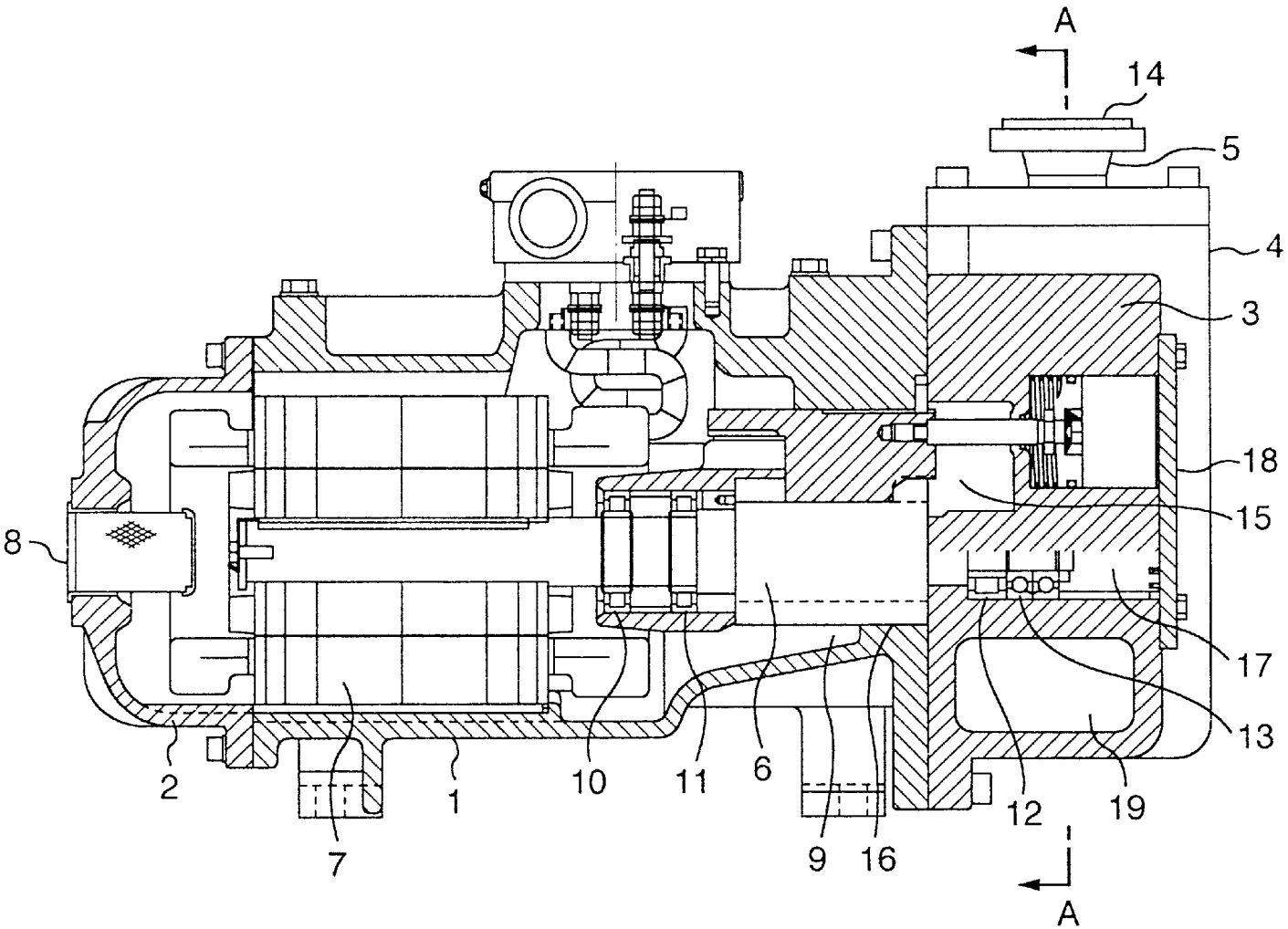
FIG. 1 is a cross sectional view showing a compressor including an oil-mist separator of the invention.

As shown in FIG. 1, a screw compressor of the invention has a pair of male and female rotors 6, roller bearings 10–12, ball bearings 13, an electric motor 7, a casing 1 for receiving a compression mechanism as described above, a motor cover 2 including an inlet 8 for taking therefrom into the compressor a gas to be compressed, and a discharge casing 3 including an outlet 14 for discharging therefrom the compressed gas to an outside of the compressor.

The casing 1 has a cylindrical bore 16 and an inlet port 9 for introducing the gas into the cylindrical bore 16, the cylindrical bore 16 receives therein the pair of mutually engaging male and female rotors 6 rotatably supported by the bearings 10–12 and ball bearings 13, and one of the male and female rotors 6 is connected to the electric motor 7.

An inlet passage 15 for the refrigerant gas extends from the cylindrical bore 16 to a chamber 4 formed in the discharge casing 3. The discharge casing 3 is fixed to the casing 1 by bolts or the like. A shelter plate 18 is mounted on an end of the discharge casing 3 to close a bearing room 17 containing therein the roller bearing 12 and ball bearing 13. An oil reservoir 19 is formed at a lower portion of the discharge casing 3, and a lubrication path extends from the oil reservoir 19 to each of the bearings.

Figure 2A:
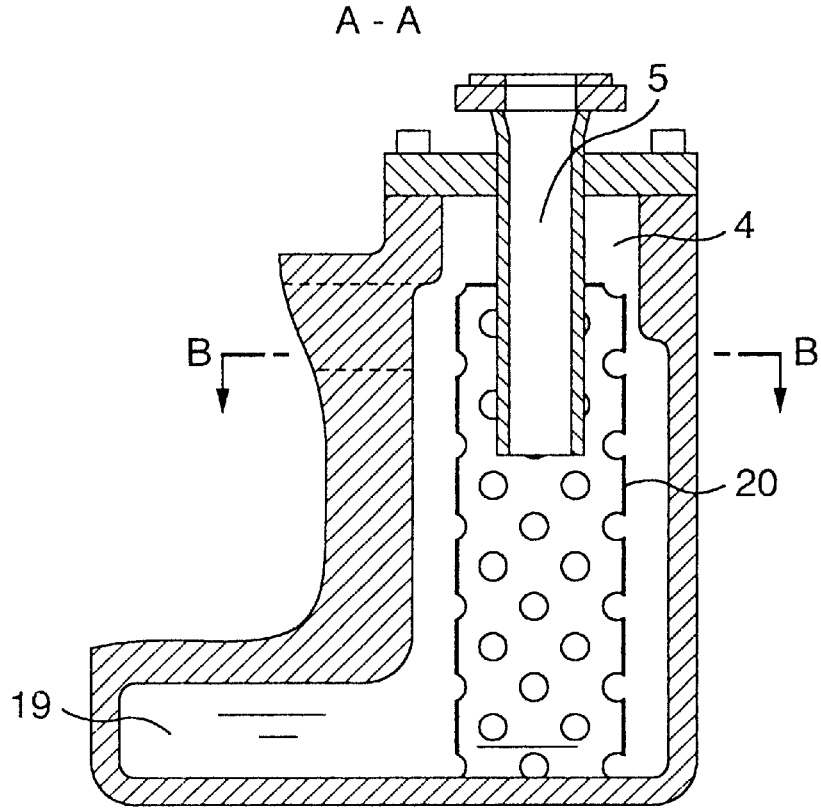
FIG. 2*a* is a cross sectional view taken along an imaginary plane A—A in FIG. 1 to show an oil-mist separator of the invention.
Figure 2B:
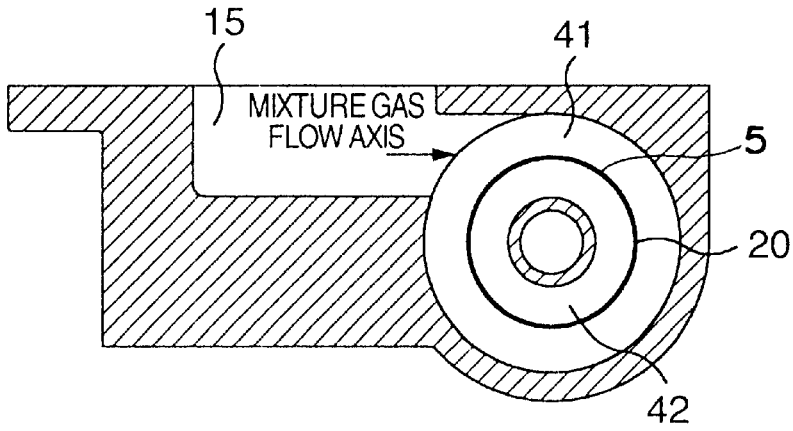
FIG. 2*b* is a cross sectional view taken along an imaginary plane B—B in FIG. 2*a*.

The chamber 4 formed in the discharge casing 3 is vertically-extending-hole-shaped as shown in FIG. 2*a*, for example, cylindrical or polygonal in horizontal cross section. Therefore, a horizontal cross section of the chamber 4 is annular, for example, circular, and a tubular member 5 in which a discharge passage communicating with the outlet 14 is formed is arranged coaxially in the cylindrical chamber to project into a cylindrical region of the chamber 4, for example, to a vertically half or center position of the cylindrical region of the chamber 4.

The refrigerant gas of low temperature and low pressure taken-in from the inlet 8 of the motor cover 2 passes a gas path formed between the electric motor 7 and the casing 1 and a gap between a motor stator and a motor rotor to cool the electric motor 7, and proceeds through the inlet port 9 of the casing 1 into a compressing chamber formed between the casing 1 and mutually engaging teeth of the male and female screw rotors 6 to be compressed in the compressing chamber whose volume decreases in accordance with a rotation of the male screw rotor connected to the electric motor 7. The gas of high temperature and high pressure flows from the compressing chamber through the inlet passage 15 into the chamber 4 while a flow axis (that is, central axis) of the gas reaching the chamber 4 is directed or guided by the inlet passage 15. A volume of the chamber 4 is 15–40% of a gas flow rate per hour discharged from the compressor to separate effectively a lubricant oil from the gas. A radial load of the male and female screw rotors 6 is borne by the roller bearings 10–12, and a thrust load thereof is borne by the ball bearings 13.

The oil for lubricating and cooling the bearings is collected and stored by the oil reservoir 19 to which the high pressure of the compressed gas is applied, so that the lubricant oil is supplied or returned to the bearings by a pressure difference.

The tubular member 5 is surrounded by a perforated baffle plate 20 arranged between the tubular member 5 and a vertically extending annular inner surface of the chamber 4, preferably coaxially with the vertically extending annular inner surface of the chamber 4, so that the chamber 4 is divided by the baffle plate 20 to a radially outer space 41 and a radially inner space 42 communicating with each other through through-holes of the baffle plate 20 made of preferably a punching metal plate.

The inlet passage 15 extends along a tangential line of a point of the annular inner surface of the chamber 4 at which point the inlet passage 15 joins the annular inner surface of the chamber 4 so that a mixture of the refrigerant gas and the lubrication oil directed by the inlet passage 15 is converted effectively to a swirl gas flow flowing along the annular inner surface of the chamber 4. The lubrication oil is urged radially outward by a centrifugal force of the swirl gas flow to be pressed against the annular inner surface of the chamber 4 so that the lubrication oil is separated from the mixture.

The separated oil is urged by the swirl gas flow to be mixed with the gas, however, the baffle plate 20 restrains the oil from reaching a discharge port of the discharge passage and collects the oil, so that the oil is held in the radially outer space 41 to be pressed against the annular inner surface of the chamber 4 by the centrifugal force of the swirl gas flow and is separated from the mixture. The oil collected by the inner surface of the chamber 4 flows down to the oil reservoir 19, and the gas is discharged to the outside of the compressor through the discharge port of the discharge passage.

Figure 3A:
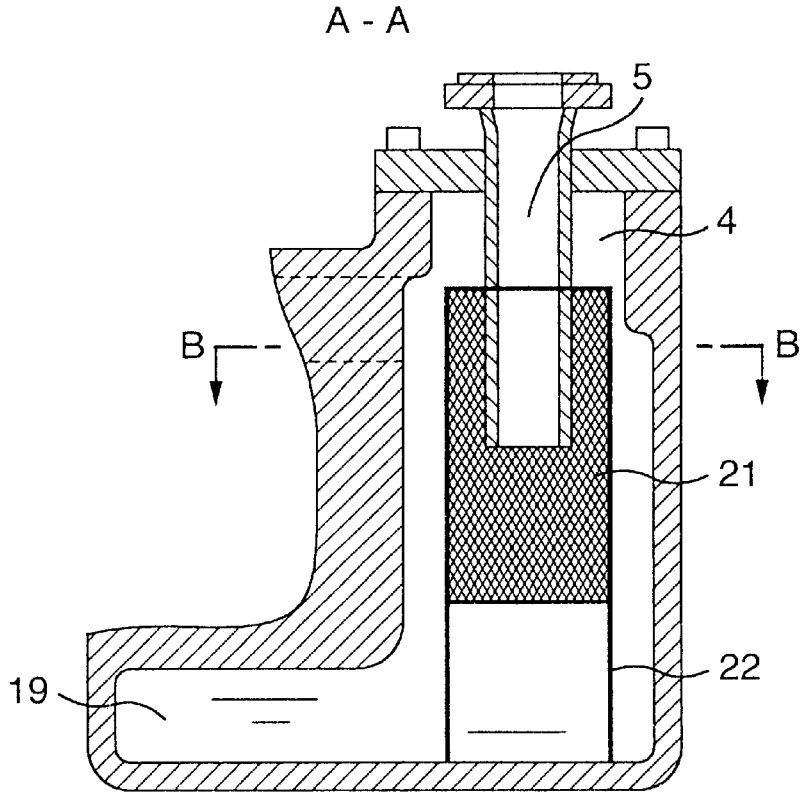
FIG. 3*a* is a cross sectional view taken along an imaginary plane A—A in FIG. 1 to show another oil-mist separator of the invention.
Figure 3B:
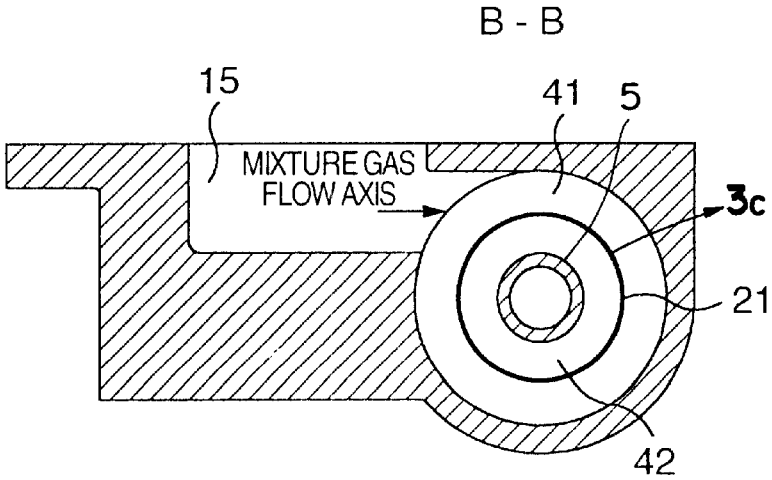
FIG. 3*b* is a cross sectional view taken along an imaginary plane B—B in FIG. 3*a*.
Figure 3C:
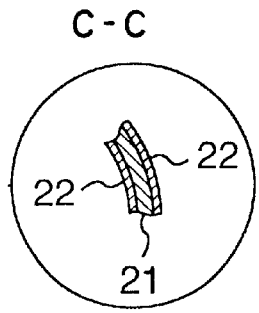
FIG. 3*c* is an enlarged cross sectional view of the portion 3*c* in FIG. 3*b*.
Figure 4A:
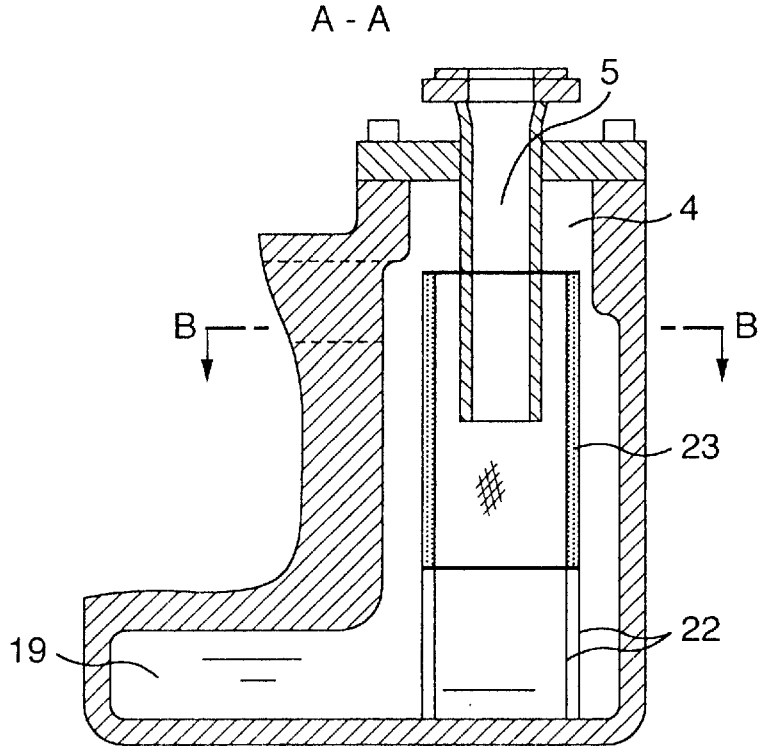
FIG. 4*a* is a cross sectional view taken along an imaginary plane A—A in FIG. 1 to show another oil-mist separator of the invention.
Figure 4B:
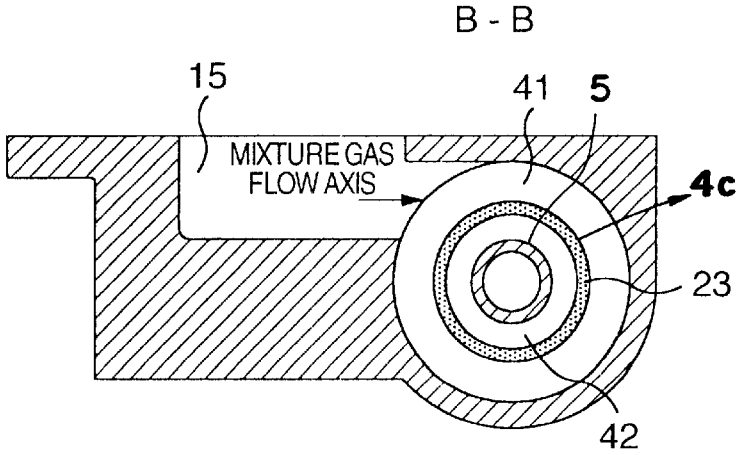
FIG. 4*b* is a cross sectional view taken along an imaginary plane B—B in FIG. 4*a*.
Figure 4C:
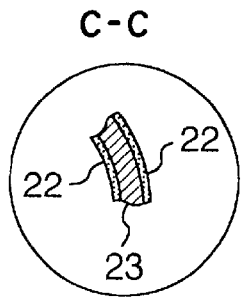
FIG. 4*c* is an enlarged cross sectional view of the portion 4*c* in FIG. 4*b*.

As shown in FIG. 3, the baffle plate 20 may be formed by a wire fine mesh 21 not less than 100 mesh, and a pair of wire nets 22 of 1-10 mesh between which the wire fine mesh is arranged. As shown in FIG. 4, the baffle plate 20 may be formed by a mesh wire pad 23, and the pair of wire nets 22 of 1-10 mesh between which the mesh wire pad 23 is arranged.

Figure 5A:
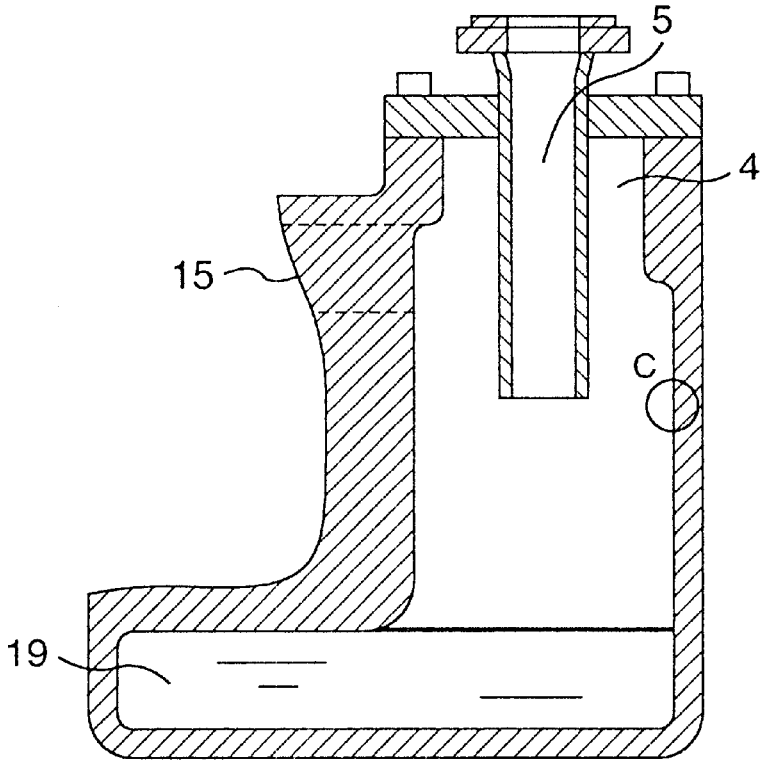
FIG. 5 is a cross sectional view taken along an imaginary plane A—A in FIG. 1 to show another oil-mist separator of the invention.
Figure 5B:
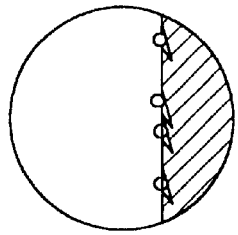
Figure 6A:
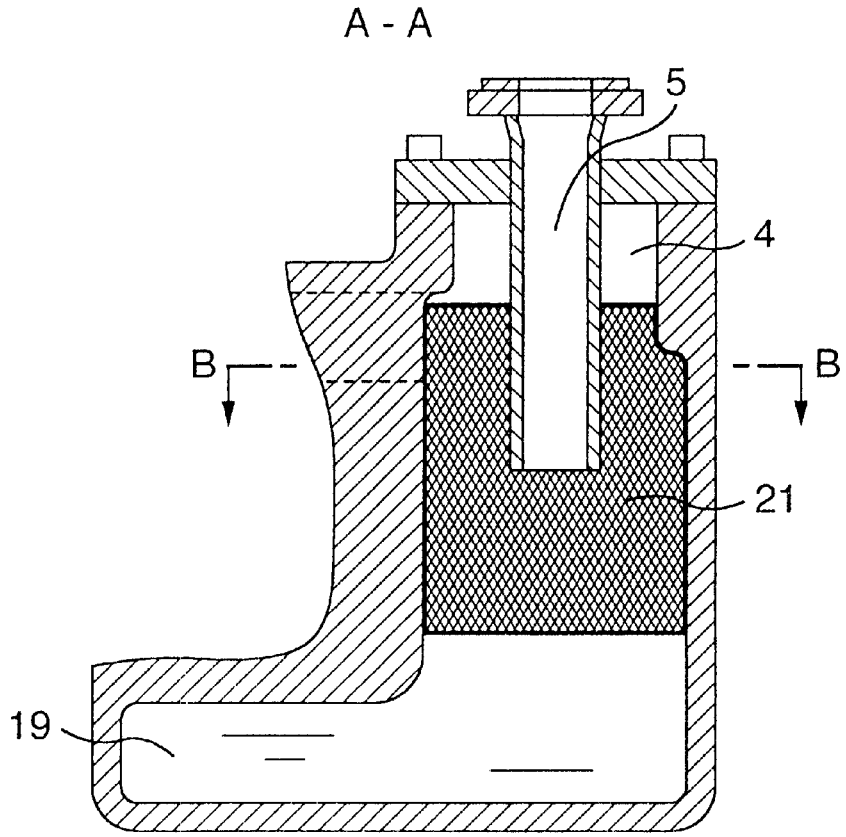
FIG. 6*a* is a cross sectional view taken along an imaginary plane A—A in FIG. 1 to show another oil-mist separator of the invention.
Figure 6B:
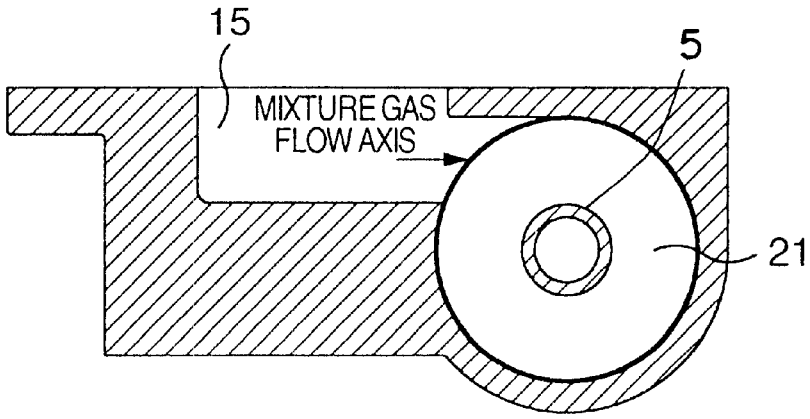
FIG. 6*b* is a cross sectional view taken along an imaginary plane B—B in FIG. 6*a*.

As shown in FIG. 5, the annular inner surface of the chamber 4 may be a shot blasted surface so that a roughness of the annular inner surface by the shot blasting collects effectively the oil and holds securely the collected oil against the swirl gas flow to guide the oil toward the oil reservoir 19. As shown in FIG. 6, the annular inner surface of the chamber 4 may be formed by the wire fine mesh 21 not less than 100 mesh or a glass wool to collect effectively the oil and hold securely the collected oil against the swirl gas flow to guide the oil toward the oil reservoir 19.

Figure 7A:
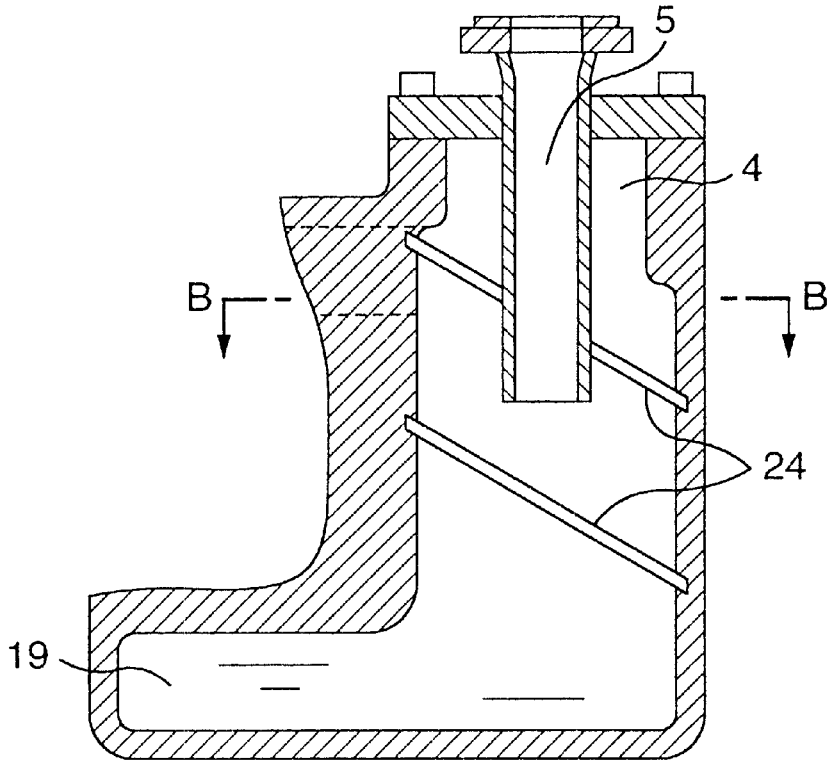
FIG. 7*a* is a cross sectional view taken along an imaginary plane A—A in FIG. 1 to show another oil-mist separator of the invention.
Figure 7B:
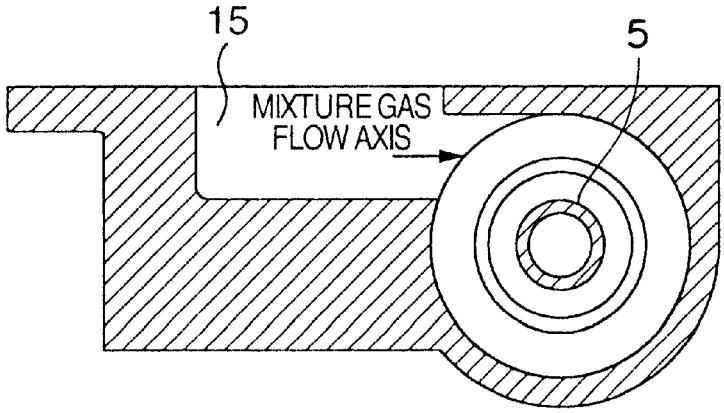
FIG. 7*b* is a cross sectional view taken along an imaginary plane B—B in FIG. 7*a*.

As shown in FIG. 7, a spiral groove 24 may be formed on the annular inner surface of the chamber 4. The spiral groove 24 extends in such a manner that the swirl gas flow proceeds downward toward the oil reservoir 19 while the swirl gas flow proceeds along the spiral groove 24 to collect effectively the oil and hold securely the collected oil against the swirl gas flow to guide the oil toward the oil reservoir 19. A straight vertical groove may be formed on the annular inner surface of the chamber 4. The spiral groove 24 and/or straight vertical groove may be used in combination with at least one of the embodiments shown in FIGS. 2–6.

Figure 8A:
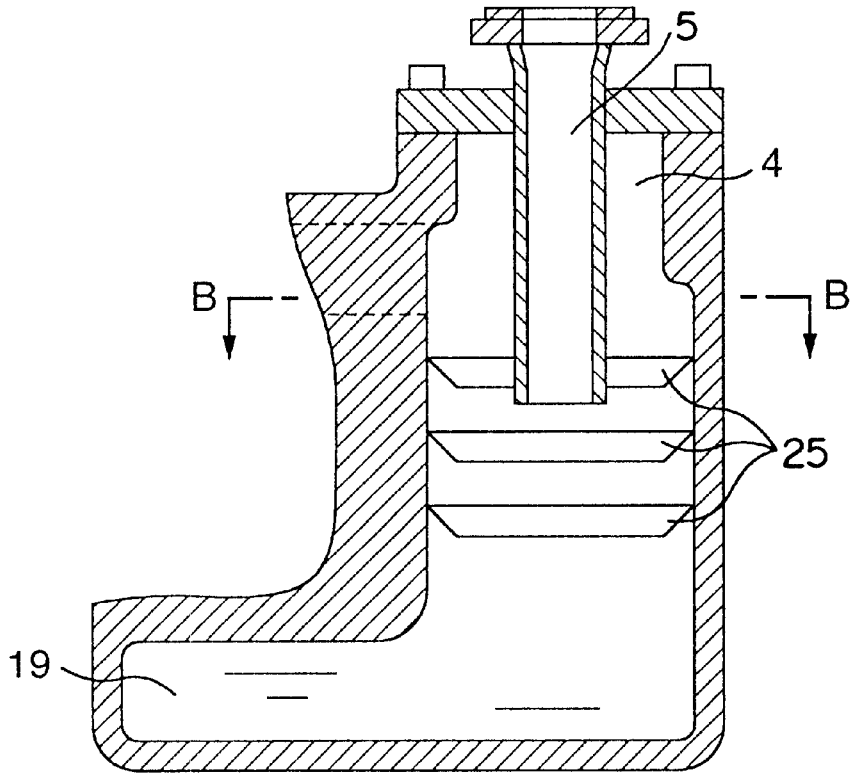
FIG. 8*a* is a cross sectional view taken along an imaginary plane A—A in FIG. 1 to show another oil-mist separator of the invention.
Figure 8B:
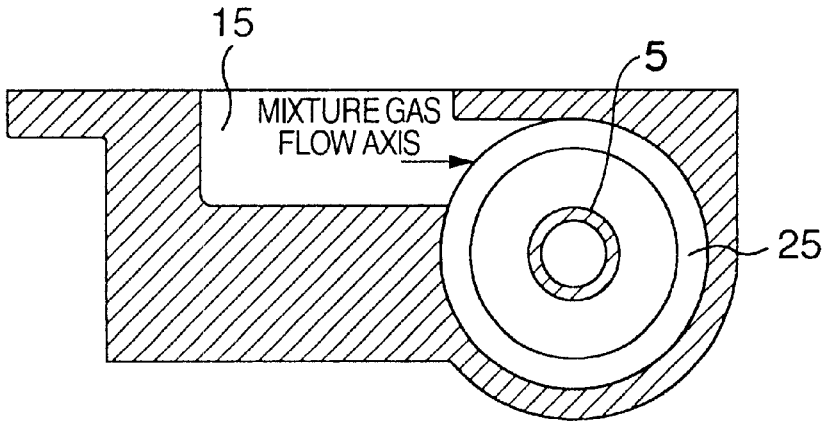
FIG. 8*b* is a cross sectional view taken along an imaginary plane B—B in FIG. 8*a*.

As shown in FIG. 8, at least one ring-shaped member 25 may be arranged in the chamber 4. The ringshaped member 25 has a tapered surface whose diameter decreases vertically downward. The oil urged vertically upward by the gas flow is collected by the tapered surface and is directed radially outward toward the annular inner surface of the chamber 4 by the tapered surface so that the oil is effectively collected by the tapered surface and the annular inner surface of the chamber 4. A spiral member may be arranged in the chamber 4. The spiral member extends in such a manner that the swirl gas flow proceeds downward toward the oil reservoir 19 while the swirl gas flow proceeds along the spiral member to collect effectively the oil and hold securely the collected oil against the swirl gas flow to guide the oil toward the oil reservoir 19. The chamber 4 may be formed in an oil mist separator which is not integrally formed with the compressor.

What is claimed is:

1. A compressor for compressing a mixture gas including a mist of lubrication oil and a gas to be taken out of the compressor with a pressurized condition, comprising, a pair of compressing members movable with respect to each other so that the mixture gas is compressed therebetween, a motor for driving at least one of the compressing members to generate a relative movement between the compressing members for compressing the mixture gas, and an oil-mist separator for separating the mist of lubrication oil from the mixture gas to collect the lubrication oil, wherein the oil-mist separator includes an inner surface forming a chamber for receiving the mixture gas, an inlet passage for directing a flow axis of the mixture gas when the mixture gas reaches the chamber, and a discharge passage including a discharge port opening in the chamber to discharge the gas from the chamber through the discharge port, wherein the inner surface of the oil-mist separator includes a groove having a spiral shape whose axis extends vertically, the spiral shape being formed in such a manner that the mixture gas is urged vertically downward by the groove when the mixture gas whose flow axis is directed by the inlet passage proceeds circumferentially in the chamber, and wherein an imaginary extension line of a lower end of the inlet passage traverses the groove having the spiral shape as seen in a direction perpendicular to the axis of the groove having the spiral shape.

2. A compressor according to claim 1, wherein the chamber is cylindrical.

3. A compressor according to claim 1, wherein the chamber and the discharge port are coaxial.

4. A compressor according to claim 1, wherein the discharge port is prevented from facing to the inlet passage.

5. A compressor according to claim 1, wherein the inlet passage extends in such a manner that the flow axis of the mixture gas is directed by the inlet passage to an annular part of the inner surface so that the mixture gas swirls along the annular part of the inner surface.

6. A compressor according to claim 1, wherein the inlet passage extends in such a manner that the flow axis of the mixture gas directed by the inlet passage is prevented from being perpendicular to an imaginary tangential plane of a point of the inner surface on the flow axis so that the mixture gas directed by the inlet passage is restrained from being divided at the point of the inner surface to at least two mixture gas components whose flow directions are opposite to each other.

7. A compressor according to claim 1, wherein the inner surface includes at least one of a glass-wool, a wire net, and a shot-blasted surface.

8. A compressor according to claim 1, wherein the discharge port opens vertically downward.

9. A compressor according to claim 1, wherein the inlet passage includes at an end thereof an inlet port opening to the chamber, and the discharge port is arranged at a position lower than the inlet port.

10. A compressor according to claim 1, wherein the inlet passage extends horizontally to direct the flow axis of the mixture gas horizontally when the mixture gas reaches the chamber and includes at an end thereof an inlet port opening to the chamber, and the discharge port opens at a position lower than the inlet port.

11. A compressor according to claim 1, wherein an axis of the inlet passage traverses the groove of spiral shape as seen in the direction perpendicular to the axis of the groove of spiral shape.

12. A compressor according to claim 1, further comprising a tubular member whose inner surface forms the discharge passage, wherein the tubular member projects in the chamber and is surrounded circumferentially by the groove of spiral shape as seen vertically, and the inner surface is spaced from the tubular member along the groove of spiral shape to form a cylindrical clearance between the inner surface and the tubular member over the groove of spiral shape as seen in the direction perpendicular to the axis of the groove of spiral shape.

13. A compressor according to claim 1, further comprising a tubular member whose inner surface forms the discharge passage, wherein the tubular member projects in the chamber to be surrounded circumferentially by the mixture gas.

14. A compressor according to claim 13, wherein the tubular member projects vertically downward in the chamber.

15. A compressor according to claim 1, further comprising a baffle arranged between the discharge port and the inner surface to bend a flow direction of the mixture gas toward the discharge port.

16. A compressor according to claim 15, wherein the baffle extends to a vertical position higher than the discharge port.

17. A compressor according to claim 15, wherein the inlet passage extends horizontally to direct the flow axis of the mixture gas horizontally when the mixture gas reaches the chamber and includes at an end thereof an inlet port opening to the chamber, and the baffle extends to a position higher than at least a portion of the inlet port.

18. A compressor according to claim 15, wherein the baffle includes a sheet having through-holes through which the mixture gas is allowed to flow toward the discharge port.

19. A compressor according to claim 18, wherein the sheet includes at least one of a glass-wool, a wire net and a perforated sheet.

20. A compressor according to claim 18, wherein the baffle includes a pair of the sheets, and each of the sheets has the through-holes so that a flow direction of the mixture gas toward the discharge port is bent by each of the plates.

21. A compressor according to claim 20, wherein an opening area of each of the through-holes of one of the sheets is different from an opening area of each of the through-holes of another one of the sheets.

* * * * *